US005852828A

United States Patent [19]

Foster

[11] Patent Number: 5,852,828

[45] Date of Patent: Dec. 29, 1998

[54] CONVERTIBLE FLY FISHING VEST

[76] Inventor: Ronald W. Foster, 3S322 Deerpath Rd., Batavia, Ill. 60510

[21] Appl. No.: 909,822

[22] Filed: Aug. 12, 1997

[51] Int. Cl.[6] ..... A41D 13/00

[52] U.S. Cl. ..... 2/102; 2/94

[58] Field of Search ..... 2/102, 108, 85, 2/93, 94, 95, 69, DIG. 1

[56] References Cited

U.S. PATENT DOCUMENTS

| | | | |
|---|---|---|---|
| 2,079,980 | 5/1937 | Anders . | |
| 2,142,814 | 1/1939 | Fitch | 2/93 |
| 2,678,447 | 5/1954 | Bracken | 2/94 |
| 2,989,754 | 6/1961 | Bukspan | 2/87 |
| 3,085,250 | 4/1963 | Finlay . | |
| 3,086,215 | 4/1963 | DiPaola | 2/93 |
| 3,651,520 | 3/1972 | Jacob . | |
| 3,921,224 | 11/1975 | Ingram, III . | |
| 4,217,663 | 8/1980 | Goldberg et al. | 2/102 |
| 4,513,451 | 4/1985 | Brown . | |
| 4,796,304 | 1/1989 | Shelby . | |
| 4,998,654 | 3/1991 | Bruzek et al. . | |
| 5,031,244 | 7/1991 | Inagaki . | |
| 5,040,243 | 8/1991 | Tatsuno . | |
| 5,247,707 | 9/1993 | Parker et al. . | |
| 5,265,782 | 11/1993 | McNamara | 2/108 X |
| 5,617,582 | 4/1997 | Burwell . | |

OTHER PUBLICATIONS

Cabela's Fly Fishing—1996; pp. 86–87 Fishing Vests Jan. 1996.

*Primary Examiner*—Gloria M. Hale

*Attorney, Agent, or Firm*—Jacobson, Price, Holman & Stern, PLLC

[57] ABSTRACT

A fly fishing vest having a mesh panel forming a rear portion of the vest with a removable rear panel secured to cover substantially the entire mesh panel until it is desired to provide additional ventilation to the fly fishing person. At that time, an upper edge of the rear panel is disconnected from the vest. In addition, side panel portions are unsnapped from connection to the vest. The rear panel is then rolled into an unzippered pocket from which the rear panel extends and in which one edge of the rear panel is anchored. Upon successful placement of the rear panel in the pocket extending laterally across the rear of the vest, the pocket is zippered to contain the rear panel in place until needed again. With the rear panel secured in the pocket, 100% of the mesh panel at the rear portion of the vest is exposed to provide a substantial increase in ventilation for the fly fishing person.

18 Claims, 6 Drawing Sheets

CONVERTIBLE FLY FISHING VEST

FIELD OF THE INVENTION

The present invention relates to a fly fishing vest including a rear panel portion covering a mesh panel member. The rear panel portion is removable to increase ventilation through the mesh panel member.

BACKGROUND OF THE INVENTION

The recreational sport of fishing, often called angling, as contrasted with commercial fishing, involves the use of rods, reels, lines, and lures with hooks to catch fish. Sport angling, one of the more popular forms of recreation in the world, lets people get into the outdoors for the challenge of outwitting and then fighting a game fish.

People have been fishing since the Stone Age with pencil-shaped bone pieces used as hooks and vines as line. Fishing for sport and recreation is a somewhat newer activity, although traceable through history. The methods and tackle used for fishing evolved slowly through the centuries.

Modern sportfishing may be broken down between freshwater fishing and saltwater fishing. Freshwater fishing takes place in lakes, ponds, rivers, and streams. Saltwater fishing is done in the ocean and rivers affected by ocean tides. Fish in fresh water are generally smaller than fish found in salt water. Accordingly fresh water fish are caught with lighter rods, reels, and lines and with smaller lures than saltwater fishing. In lakes, ponds, and larger rivers, freshwater anglers either wade, fish from shore, or use a boat. Anglers fishing in smaller rivers, streams, and creeks generally wear waders and/or waterproof garments. The angler walks in the water to a suspected fish collecting area. Popular fresh water fish include trout, bass, salmon, walleye, blue-gill, pike and catfish.

The most sporting and difficult angling method is thought to be fly-fishing. Introduced into the United States about 1875 from England, this method is used primarily for catching trout and salmon. A fly rod typically of 7½ feet, and up to 10 feet, in length is used. This rod is lighter than rods used for bait and spin fishing.

Fly reels are also different from bait casting and spinning reels in that they are of a single action. Fly reels have a frame and revolving spool without gears, designed to only hold the line. The handle is attached directly to the spool. A turn of the handle turns the spool.

Fly lines are thicker in diameter than bait casting lines and are coated with various plastics. Some can float or sink rapidly or slowly. Once the fly fishing line is wound on the reel spool, a nylon leader is added to the end of the line. Fly leaders are much lighter than and have a smaller diameter than the actual fly line. The fly leaders let the angler cast easily.

A fly is attached to the end of the leader to disguise the hook. The fly is made of feathers, fur, silk, hair, or synthetic materials tied onto a hook. Different shapes and sizes are used to imitate a variety of insects, frogs and even mice. The fly is of very little weight. The choice of imitated insect is based upon what fish are feeding on at a particular moment.

To cast such a fly line, the angler whips the fly rod back and forth until a desired length of line is moving though the air. The line is then cast to a spot, such as pools and pockets in streams where fish may gather. The fly is allowed to touch the water and then float on or sink into the water. If a fish goes for the bait, the angler sets the hook in the fish's mouth by pulling the line by raising the top of the rod. The angler fights the fish by pulling the line by hand or by reeling in the line onto the reel.

Fishing with flies involves many variations and subtleties. Serious anglers constantly search for new information about equipment that will help them improve their fishing. One area of improvement is the comfort level of the angler. Standing in water as the sun rises can lead to a change in the heat of the day, affecting an angler's performance.

SUMMARY OF THE INVENTION

Accordingly, it is one object of the present invention to provide a convertible fly fishing vest which includes a removable rear panel. Removal of the rear panel and folding it into a pocket contained in the vest allows exposure of a mesh panel at the rear of the vest. The mesh panel allows free flow through of air to the angler so as to reduce the heat exposure to a fly fishing person.

This object is accomplished by the use of a fly fishing vest which provides initial warmth to the fly fishing person, who normally rises early to take advantage of opportune fly fishing conditions. Over time, the sun rises and the surrounding air temperature usually increases to make the fly fishing person uncomfortable.

To facilitate the increased comfort of the fly fishing person and thereby extend the length of fly fishing time, a fly fishing vest according to the present invention, includes a rear panel made of a mesh material. The rear panel is initially covered by a removable panel made of the same material as the remainder of the vest. The removable panel also includes a zippered pocket and two additional pockets having a flap with a resealable closure.

The front of the vest includes a combination of at least ten zippered and resealable flap closure pockets. The vest is made of a rip-stop material so as to prevent propagation of any holes introduced into the vest. In addition, the interior of the side walls of the front portions of the vest include at least four pockets of a zippered, resealable closure and mesh material. The pockets internally and externally of the vest are necessary to retain a plurality of lures, line and other replacement parts which are normally necessary to outfit a fly fishing person. These accessories must be close at hand and therefore, fly fishing vests have evolved to cover most surfaces with some form of pockets.

The rear panel of the vest is made of a mesh material which allows free flow of air from the interior to the exterior of the vest. In initial use, a removable rear panel covers a substantial portion of the mesh panel, preferably approximately 95%. The exposed portion of the mesh panel allows some flow through of air to release moisture generated by wading through a stream in the early morning hours.

Overtime, as the sun rises and the temperature of the day increases, it is important to provide additional ventilation to the fly fishing person. It is also important that the fly fishing person maintain their position in the water so as not to disturb passing fish or loose sight of a particularly attractive fishing area. It is also important that all of the accessories required for fly fishing be maintained close at hand. According to the present invention, even though the temperature in the surrounding environment has increased, the vest which previously provided warmth in the initial portion of a fly fishing day, now contributes to the increasing uncomfortableness of the fly fishing person as the day progresses.

Accordingly, it is another object of the present invention to provide a fly fishing vest having a mesh panel forming a rear portion of the vest with a removable rear panel secured to cover substantially the entire mesh panel until it is desired to provide additional ventilation to the fly fishing person. At that time, an upper edge of the rear panel is disconnected from the vest. In addition, side panel portions are unsnapped from connection to the vest.

The rear panel is then rolled into an unzippered pocket from which the rear panel extends and in which one edge of the rear panel is anchored. Upon successful placement of the rear panel in the pocket extending laterally across the rear of the vest, the pocket is zippered to contain the rear panel in place until needed again. With the rear panel secured in the pocket, 100% of the mesh panel at the rear portion of the vest is exposed to provide a substantial increase in ventilation for the fly fishing person. This greatly aids in the cooling of the fly fishing person.

The cooling of the fly fishing person facilitates increased fishing opportunities due to the increased comfort of the fly fishing person. In addition, all of the accessories necessary for continued fly fishing are maintained in immediate reach of the fly fishing person in the pockets located on the front of the fly fishing vest.

It is therefore an object of the present invention to provide a fly fishing vest having a front portion including a plurality of pockets and a rear portion made of a mesh material and a removable rear panel initially substantially covering the mesh panel and being secured at one end within a pocket and removably secured to the upper portion of the rear portion of the vest at an opposite edge so as to be removably secured along its top edge and rollable into the pocket along the bottom edge of the rear portion so as to expose the mesh panel.

It is yet another object of the present invention to provide a fly fishing vest having a removable rear panel secured at one edge to a bottom portion of a rear portion of the vest and including a releasably secured top edge and opposed side edges so that the rear panel is removable and concealable in a pocket extending along the bottom edge of the rear portion of the vest so as to expose a mesh panel for a substantial increase in ventilation of the vest.

It is still yet another object of the present invention to provide a fly fishing vest having a plurality of pockets on two opposed front portions, a plurality pockets on a rear panel, with the rear panel being releasably secured along a top edge and two side edges for removal and subsequent containment in a laterally extending pocket for concealment of the rear panel and exposure of a mesh panel at the rear portion of the vest so as to dramatically increase ventilation of the vest.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
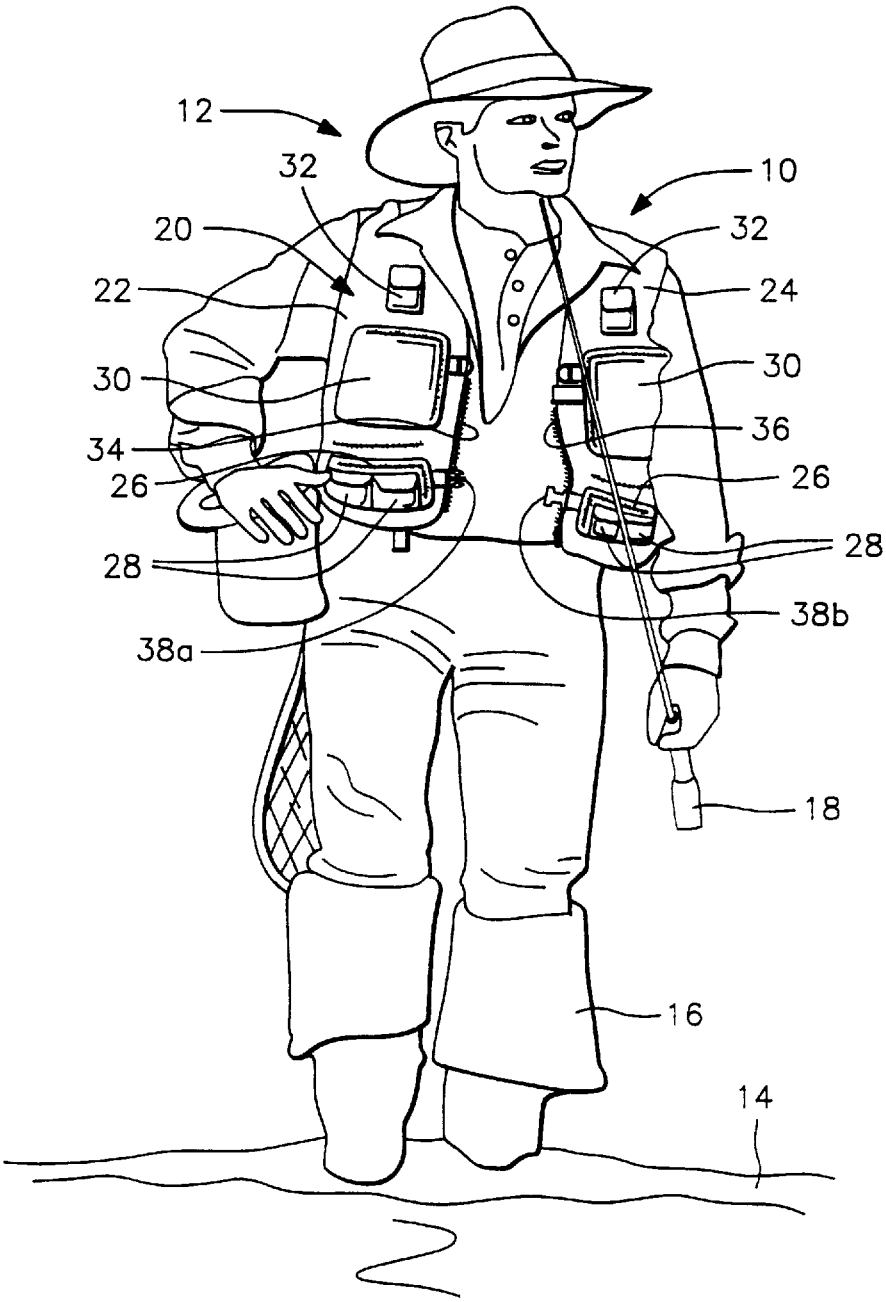
FIG. 1 illustrates a fly fishing person wading in a stream and wearing the convertible fly fishing vest of the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
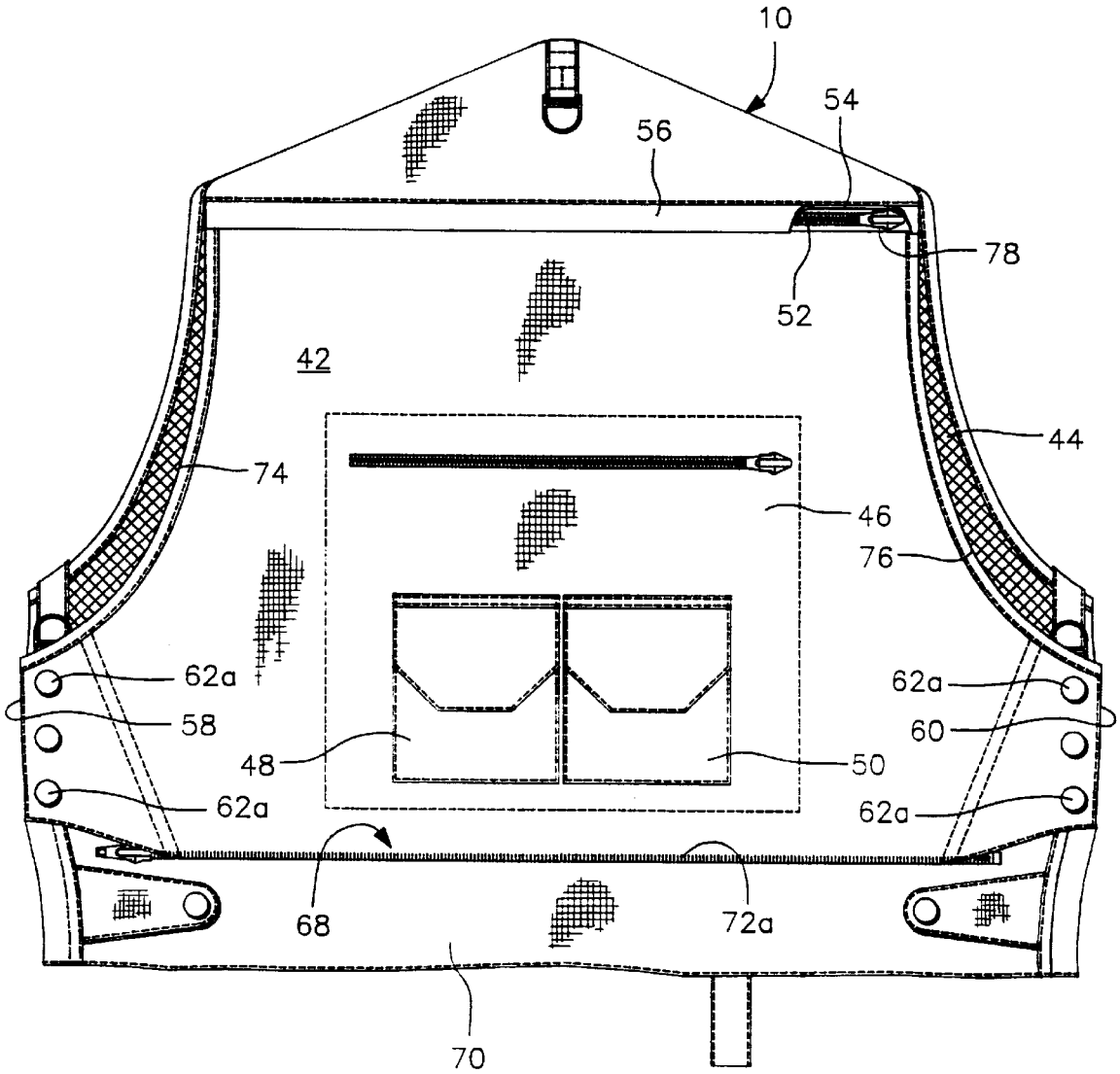
FIG. 2 is a rear view of the convertible fly fishing vest of the present invention illustrating a rear panel removably secured along an upper edge and opposed side edges to a rear portion of the vest.

With reference to the drawings, in general, and to FIGS. 1 and 2, in particular, a convertible fly fishing vest embodying the teachings of the subject invention is generally designated as 10. With reference to its orientation in FIG. 1, the vest 10 is shown worn on a fly fishing person 12 wading in a stream 14 wearing hip waders 16 and carrying a fly fishing rod 18.

The front section 20 of the vest includes two side portions 22, 24. Each side portion 22, 24 includes zippered pockets 26, and two resealable pockets 28 located on a front portion of the zippered pockets 26. Additional zippered pockets 30 are located above the zippered pockets 26. Located above the zippered pockets 30 are additional resealable pockets 32.

The two side portions 22, 24 are interconnected by zippered portions 34, 36. In addition, a two part clasp 38*a* and 38*b* helps secure the two side portions 22, 24 together.

A rear section 40 of the vest, as shown in FIGS. 2 through 5, includes a rear panel portion 42 which covers a mesh panel member 44. The rear panel portion 42 includes a zippered pocket 46 on top of which are located two resealable pockets 48, 50.

A top edge 52 of the rear panel portion 42 includes a zipper connection for securing the top edge of the rear panel portion with a top edge 54 of the rear section 40. A flap 56 covers the zippered interconnection from view.

Opposed side edges 58, 60 of the rear panel portion 42 include a plurality of snap portions 62*a* for connecting the side portions to the rear section 40 of the vest. A bottom edge 64 of the rear panel portion is secured within a laterally extending pocket 68, extending along a bottom portion 70 of the rear portion 40. The pocket 68 includes interconnecting zipper parts 72*a*, 72*b* for sealing the pocket 68.

Figure 3:
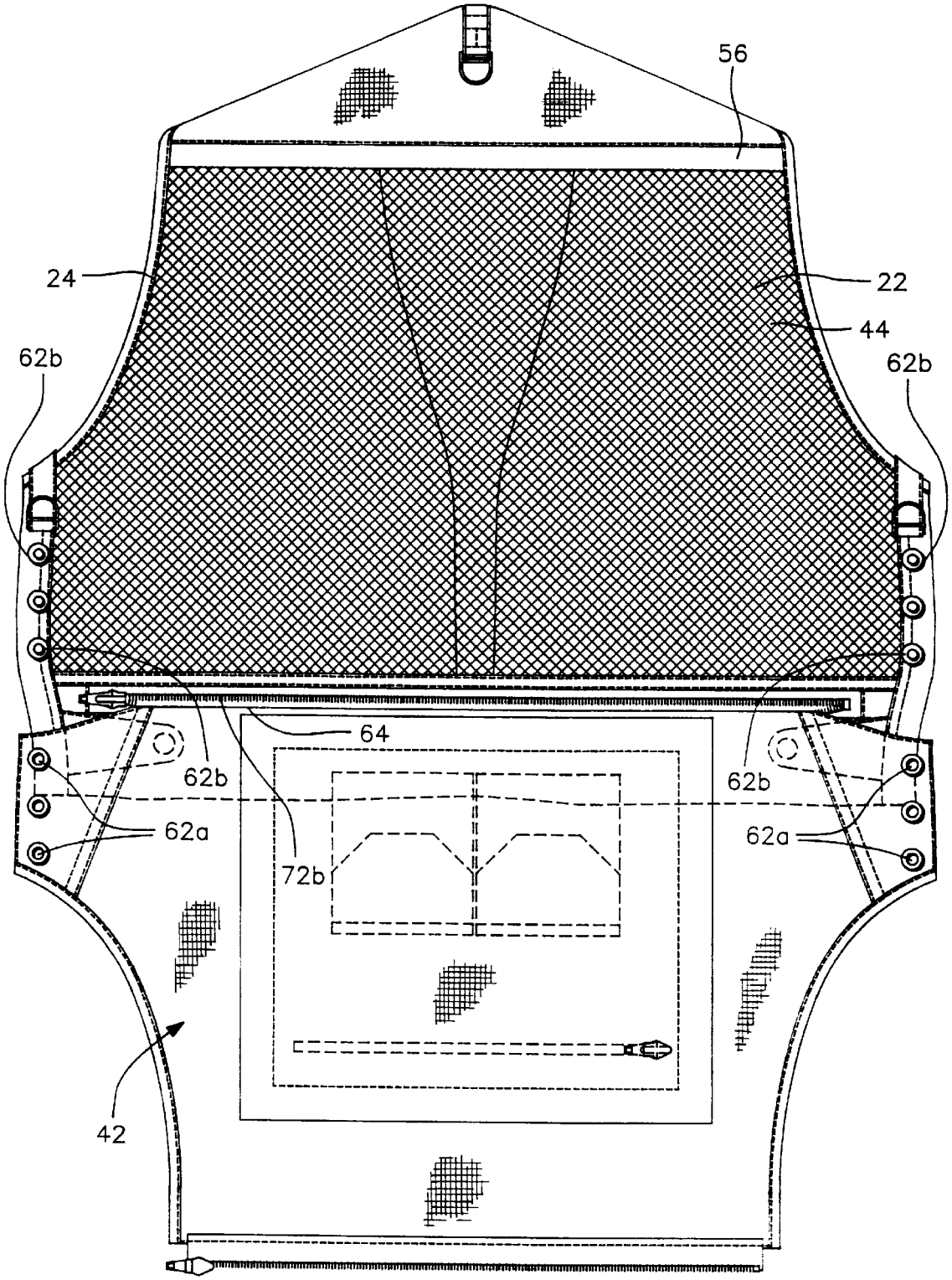
FIG. 3 illustrates the rear panel disconnected from the rear portion of the vest along its top edge and opposed side edges and laid flat so as to expose an upper edge of a zippered compartment from which the lower edge of the rear panel extends.
Figure 4:
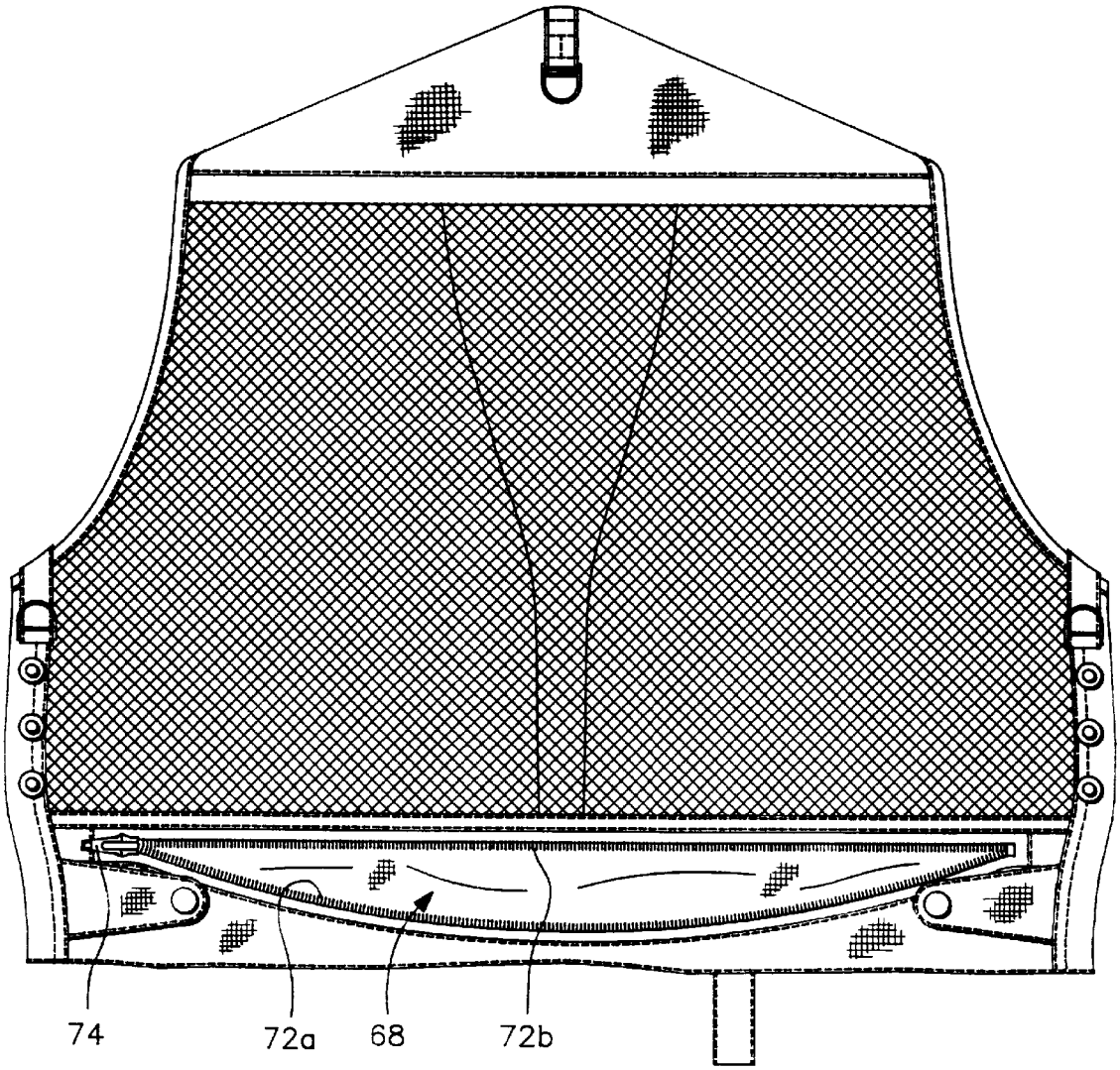
FIG. 4 illustrates the placement of the rear panel of the vest located within a zippered compartment so as to expose a mesh panel in the rear portion of the vest which allows ventilation of the fly fishing person.
Figure 5:
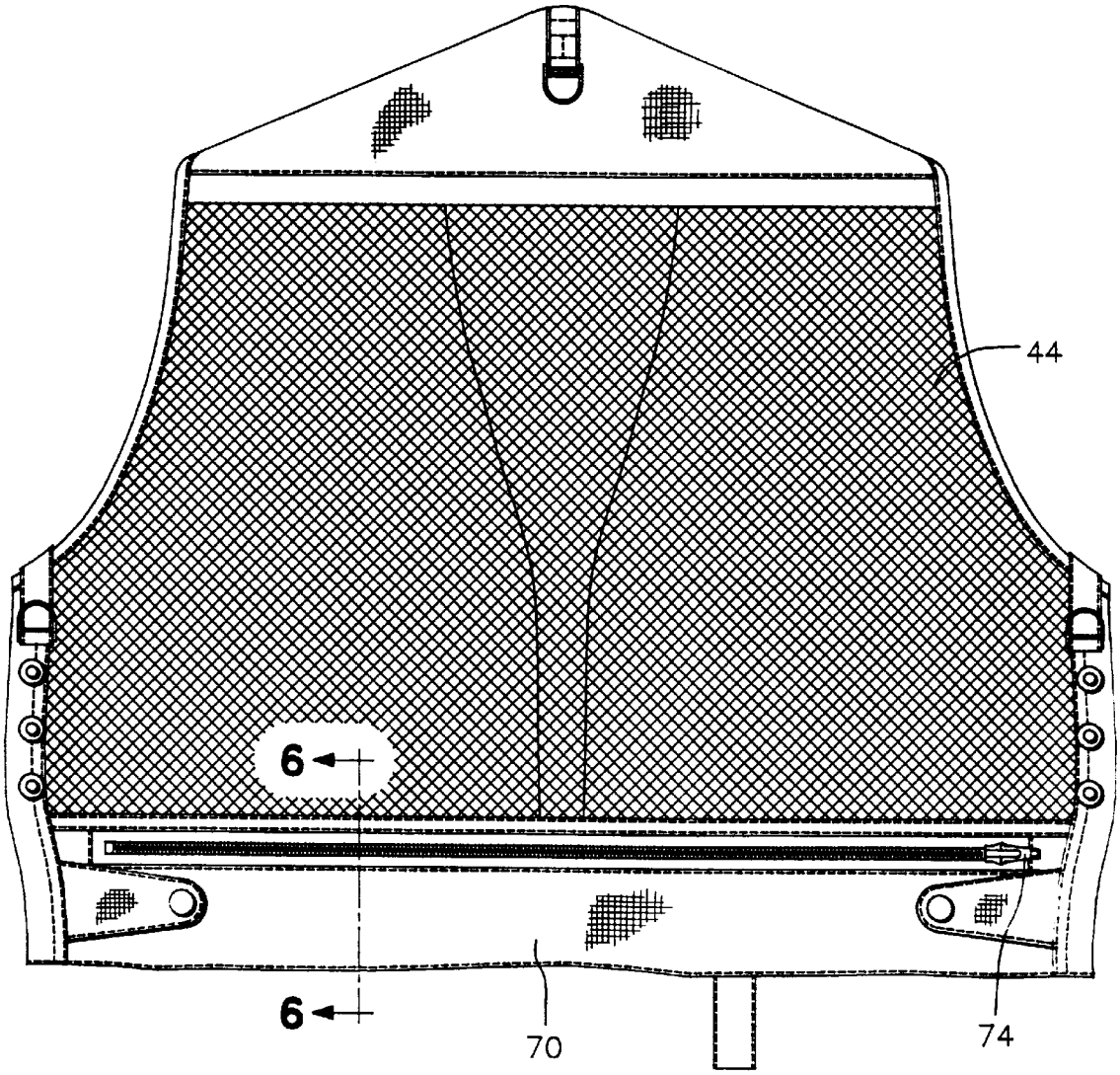
FIG. 5 illustrates the rear panel sealed in a laterally extending zippered compartment at the bottom portion of the rear portion of the vest.

In FIG. 2, a small portion, preferably approximately 5% of the mesh panel member 44 is exposed beyond the curved edges 74, 76 of the rear panel portion 42. The mesh panel member 44 opens into the interior of the vest and thereby provides limited ventilation to the interior of the vest when the rear panel portion 42 is in the closed position as shown in FIG. 2. When zipper 78 is unzipped to separate the edge 52 from edge 54, and snap portions 62*a* are released from snap portions 62*b*, as shown in FIG. 3, the rear panel portion 42 is allowed to move 180° into a vertically oriented position overlying the bottom portion 70 of the rear section 40. In this released position, the entire mesh panel member 44 is exposed so that the side portions 22, 24 of the front of the vest are viewable through the mesh panel member 44. This position of the rear panel portion 42 allows complete ventilation of the vest through the mesh panel member 44.

To facilitate the rear panel portion 42 from interfering with the fly fishing operation, the rear panel portion 42 is rolled up into pocket 68. The zippered portions 72*a,* 72*b* are thereby exposed. The zipper 74 can then be moved from the position shown in FIG. 4 to the position shown in FIG. 5 so as to seal the pocket 68 with the rear panel portion 42 enclosed therein. The ventilation of the vest 10 through mesh panel member 44 is thereby dramatically increased.

Figure 6:
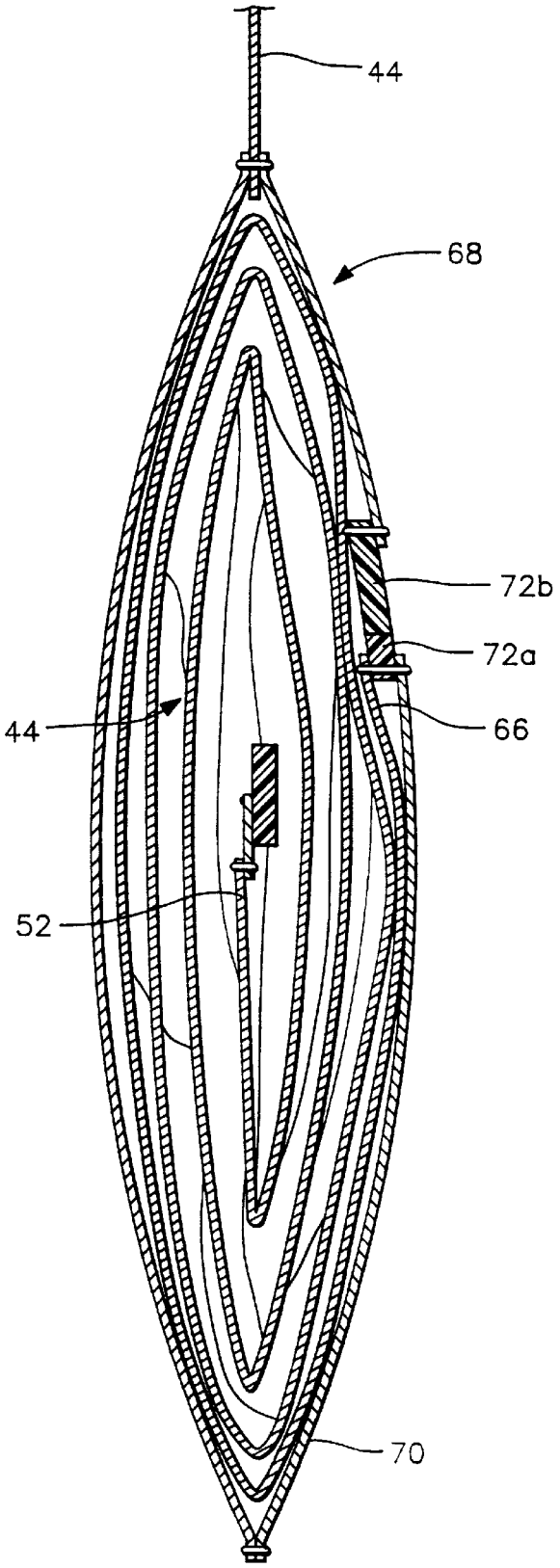
FIG. 6 is a cross-sectional view taken along line 6—6 of FIG. 5.

In FIG. 6, the mesh panel member 44 is shown rolled into the pocket 68 for storage. If the temperature in the fly fishing environment begins to drop or if it begins to rain, the rear panel portion 42 is easily removed from the pocket 68 by moving the zipper 74 so as to provide access to the rear panel portion 42. The snap connections 62*a,* 62*b* can be made to reattach the opposed side portions 58, 60 and the top edge 52 of the rear panel portion 42 zippered to the upper edge 54 of the rear section 40 by the zipper 78. The convertible fly fishing vest of the present invention is thereby easily moved from a closed position to an open position to dramatically change the amount of ventilation provided through the vest of the present invention.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A fly fishing vest comprising:

a front section including a plurality of pockets, and a rear section including a mesh panel member covered by a rear panel portion, said rear panel portion being removable to expose said mesh panel member and allow ventilation of the fly fishing vest.

2. A fly fishing vest as claimed in claim 1, wherein said rear panel portion covers approximately 95% of said mesh panel member.

3. A fly fishing vest as claimed in claim 1, wherein said rear panel portion is anchored at one end in a pocket of said rear section and an opposite end of said rear panel section is removably secured to said rear section.

4. A fly fishing vest as claimed in claim 3, wherein said rear panel portion includes opposed side edges, said opposed side edges are removably secured to said rear section.

5. A fly fishing vest as claimed in claim 4, wherein said rear panel portion is removably secured in said pocket upon disconnection of said opposite end and said opposed side edges from said rear section.

6. A fly fishing vest as claimed in claim 3, wherein said one end is connected to said rear section by a zipper.

7. A fly fishing vest as claimed in claim 4, wherein said opposed side edges are connected to said rear section by snaps.

8. A fly fishing vest as claimed in claim 1, wherein said mesh panel member extends across a majority of said rear section.

9. A fly fishing vest as claimed in claim 3, wherein said pocket extends laterally across substantially an entire width of a bottom portion of said rear section.

10. A fly fishing vest as claimed in claim 1, wherein said rear panel portion includes a plurality of pockets.

11. A convertible fly fishing vest comprising:

a front section divided into opposed portions, said front section including a plurality of pockets, and a rear section including a mesh panel member and a rear panel portion, said rear section being convertible between a closed position where said rear panel portion substantially covers said mesh panel member and an open position where said rear panel portion is stored in a pocket and said mesh panel member is exposed for increased ventilation of an interior of the vest.

12. A convertible fly fishing vest as claimed in claim 11, wherein one end of said rear panel portion is anchored in said pocket and an opposite end of said rear panel portion is removably secured to said rear section.

13. A convertible fly fishing vest as claimed in claim 12, wherein said rear panel portion includes opposed side edges, said opposed side edges are removably secured to said rear section.

14. A convertible fly fishing vest as claimed in claim 13, wherein said rear panel portion is removably secured in said pocket upon disconnection of said opposite end and said opposed side edges from said rear section.

15. A convertible fly fishing vest as claimed in claim 12, wherein said one end is connected to said rear section by a zipper.

16. A convertible fly fishing vest as claimed in claim 13, wherein said opposed side edges are connected to said rear section by snaps.

17. A convertible fly fishing vest as claimed in claim 11, wherein said pocket extends laterally across substantially an entire width of a bottom portion of said rear section.

18. A convertible fly fishing vest as claimed in claim 11, wherein said rear panel portion includes a plurality of pockets.

* * * * *